US005346204A

United States Patent [19]

Endoh et al.

[11] Patent Number: 5,346,204

[45] Date of Patent: Sep. 13, 1994

[54] SHEET ARRANGING DEVICE AND SHEET SORTER

[75] Inventors: Toshio Endoh; Hiroshi Tobita; Hiroshi Yamamoto, all of Naka, Japan

[73] Assignee: Ikegami Tsushinki Co., Ltd., Tokyo, Japan

[21] Appl. No.: 87,323

[22] Filed: Jul. 8, 1993

[30] Foreign Application Priority Data

Jul. 13, 1992 [JP] Japan ..... 4-185429

[51] Int. Cl.[5] ..... B65H 39/10; B65H 9/00

[52] U.S. Cl. ..... 271/294; 271/220; 271/236; 271/293

[58] Field of Search ..... 271/220, 221, 236, 250, 271/293, 294, 184, 207

[56] References Cited

U.S. PATENT DOCUMENTS

| | | | |
|---|---|---|---|
| 4,319,743 | 3/1982 | Rood | 271/236 X |
| 4,500,085 | 2/1985 | Rayfield et al. | 271/236 X |
| 5,020,785 | 6/1991 | Kosaka et al. . | |

FOREIGN PATENT DOCUMENTS

| | | |
|---|---|---|
| 0033835 | 8/1981 | European Pat. Off. . |
| 0486928 | 5/1992 | European Pat. Off. . |
| 62-244869 | 10/1987 | Japan . |
| 63-47265 | 2/1988 | Japan . |
| 63-267660 | 11/1988 | Japan . |
| 1-236163 | 9/1989 | Japan . |
| 1-317957 | 12/1989 | Japan . |
| 4-85087 | 3/1992 | Japan . |

*Primary Examiner*—Robert P. Olszewski
*Assistant Examiner*—Boris Miley
*Attorney, Agent, or Firm*—Oliff & Berridge

[57] ABSTRACT

A first guide groove and a second guide groove are formed on a device housing at predetermined positions in such a manner that a first pin disposed at one end of a movable member is displaceably fitted into the first guide groove and a second pin disposed at the other end of the same is displaceably fitted into the second guide groove. To slidably displace the first pin along the first guide groove, a cam is operatively connected to a geared motor. An arm 41 having a frictional member attached to the uppermost end thereof is fixedly secured to the movable member.

13 Claims, 7 Drawing Sheets

SHEET ARRANGING DEVICE AND SHEET SORTER

BACKGROUND OF THE INVENTION

Field of the Invention

The present invention relates to a sheet arranging device for properly arranging sheets in the superimposed structure by displacing each sheet placed at a predetermined position on a tray in a predetermined arranging direction. Further, the present invention relates to a sheet sorter having a sheet arranging device of the foregoing type accommodated therein.

Description of the Related Art

A conventional sheet arranging device having a sheet sorter accommodated therein for selectively sorting sheets on one of a plurality of trays is constructed such that a roller adapted to be rotationally driven by a motor is brought in contact with the upper surface of a sheet placed on the tray and the sheet is then displaced in a predetermined direction by rotating the roller so as to properly arrange sheets in the superimposed state. In addition, another conventional sheet arranging device of the foregoing type is constructed such that sheets placed on a tray are vibratively clapped by bars or similar members each extending across the opposite sides of the tray in the vertical direction until they are properly arranged on the tray in the superimposed state.

With each of the conventional sheet arranging devices constructed in the above-described manner, however, there arises a problem that the whole structure of the sheet arranging device is undesirably designed in large dimensions, resulting in the sheet arranging device being manufactured at an expensive cost . Especially, in the case that the sheet arranging device is accommodated in the narrow space inside of a sheet sorter, there arises another problem that it is practically difficult to adequately accommodate the sheet arranging device in the foregoing narrow space without any deterioration of the properties of the sheet sorter.

SUMMARY OF THE INVENTION

The present invention has been made in consideration of the aforementioned background.

An object of the present invention is to provide a sheet arranging device which assures that sheets can properly be arranged in the superimposed state without fail while the whole structure of the sheet arranging device is designed with small dimensions.

Another object of the present invention is to provide a sheet sorter for selectively sorting sheets on one of a plurality of trays wherein a sheet arranging device of the foregoing type is accommodated in the sheet sorter.

According to one aspect of the present invention, there is provided a sheet arranging device for properly arranging sheets on a tray in the superimposed state by displacing a sheet in a first predetermined direction, wherein the sheet arranging device comprises an arm having a frictional member disposed at the uppermost end thereof, the frictional member being brought in contact with the upper surface of a sheet with a predetermined intensity of frictional force; a first displaying unit for annularly displacing the frictional member to assume a first operative state or a second operative state, the first operative state being such that the frictional member is brought in contact with the upper surface of the sheet, and the second operative state being such that the frictional member is not brought in contact with the upper surface of the sheet; and a guiding unit for guiding the movement of the frictional member so as to allow the frictional member to move substantially in parallel with the first predetermined direction while the frictional member is held in the first operative state.

Usually, the first displacing unit may be composed of a main body having a first annular guide groove and a second guide groove formed thereon at predetermined positions, the second guide groove extending in a second predetermined direction; a movable member having the arm operatively secured thereto, the movable member including a first pin at one end and a second pin at the other end thereof, the first pin being displaceably received in the first guide groove, and the second pin being displaceably received in the second guide groove; and a second displacing unit for displacing the first pin along the first guide groove.

The second displacing unit may be composed of a U-shaped cam rotatably supported on the main body so as to allow one end of the first pin to be slidably fitted to the U-shaped cam, and a driving unit for rotationally driving the U-shaped cam in a predetermined timing relationship.

It is desirable that the movable member is designed in the substantially U-shaped configuration comprising a first arm portion having the first pin disposed thereon, a bottom portion having the second pin disposed thereon and a second arm portion, and that the arm is attached to the second arm portion via a slider adapted to slidably move in the longitudinal direction.

The guiding unit may be composed of a groove portion formed in the intermediate part of the first annular guide groove while extending substantially in parallel with the second predetermined direction, and an inclined guide surface formed on the main body so as to allow the intermediate part of the arm to come in contact with the inclined guide surface.

It is desirable that the arm is made of an elastic material and normally biased together with the slider toward the second pin by the resilient of a spring.

Also in this case, the guiding unit is likewise composed of a groove portion formed in the intermediate part of the first annular guide groove while extending substantially in parallel with the second predetermined direction, and an inclined guide surface formed on the main body so as to allow the intermediate part of the arm to come in contact with the inclined guide surface.

Basically, the distance between the second pin and the frictional member is set to larger than that between the first pin and the second pin.

In addition, according to an other aspect of the present invention, there is provided a sheet sorter having a sheet arranging device of the foregoing type accommodated therein, wherein the sheet sorter comprises a plurality of trays each displaceable in the vertical direction; a displacing unit for selectively displacing one of the plural trays to a sheet displacing position; an arm having a frictional member disposed at the uppermost end thereof, the frictional member being brought in contact with the upper surface of a sheet with a predetermined intensity of frictional force; a first displacing unit for annularly displacing the frictional member to assume a first operative state or a second operative state, the first operative state being such that the frictional member is brought in contact with the upper surface of the sheet, and the second operative state being such that the frictional member is not brought in contact with the upper surface of the sheet; and a guiding unit for guiding the movement of the frictional member so as to allow the frictional member to move in a predetermined direction relative to the trays.

Usually, the first displacing unit may be composed of a main body having a first annular guide groove and a second vertically extending guide groove formed thereon at predetermined positions thereof; a movable member having the arm operatively secured thereto, the movable member including a first pin at one end and a second pin at the other end thereof, the first pin being displaceably received in the first guide groove, and the second pin being displaceably received in the second groove; and a second displacing unit for displacing the first pin along the second guide groove.

The second displacing unit may be composed of a U-shaped cam rotatably supported on the main body so as to allow one end of the first pin to be slidably fitted to the U-shaped cam, and a driving unit for rotationally driving the U-shaped cam in a predetermined timing relationship.

It is desirable that the movable member is designed in the substantially U-shaped configuration comprising a first arm portion having the first pin disposed thereon, a bottom portion having the second pin disposed thereon and a second arm portion, and that the arm is attached to the second arm portion via a slider adapted to slidably move in the longitudinal direction.

The guiding unit may include a groove portion formed in the intermediate part of the first annular groove while extending substantially in parallel with the predetermined direction, and an inclined guide surface formed on the main body so as to allow the intermediate part of the arm to come in contact with the inclined guide surface.

It is desirable that the arm is made of an elastic material and normally biased together with the slider toward the second pin by the resilient force of a spring.

Also in this case, the guiding unit may be composed of a groove portion formed in the intermediate part of the first annular groove while extending substantially along with the predetermined direction, and an inclined guide surface formed on the main body so as to allow the intermediate part of the arm to come in contact with the inclined guide surface.

Basically, the distance between the second pin and the frictional member is set to be larger than that between the first pin and the second pin.

The above and other objects, effects, features and advantages of the present invention will become more apparent from the following description of embodiments thereof taken in conjunction with the accompanying drawings.

BRIEF DESCRIPTION OF THE DRAWINGS

The present invention is illustrated in the following drawings in which.

DETAILED DESCRIPTION OF PREFERRED EMBODIMENTS

The present invention will now be described in detail hereinafter with reference to the accompanying drawings which illustrate a preferred embodiment thereof.

First, the whole structure of a sheet sorter constructed according to the embodiment of the present invention will be described below with reference to FIG. 1 to FIG. 3. To facilitate understanding of the present invention, the description will be made especially with reference to FIG. 1 in the following manner on the assumption that the direction identified by arrow FR represents a forward direction, the direction identified by arrow RR represents a rearward direction, the direction identified by arrow RH designates a rightward direction, and the direction identified by arrow LH represents a leftward direction.

Figure 1:
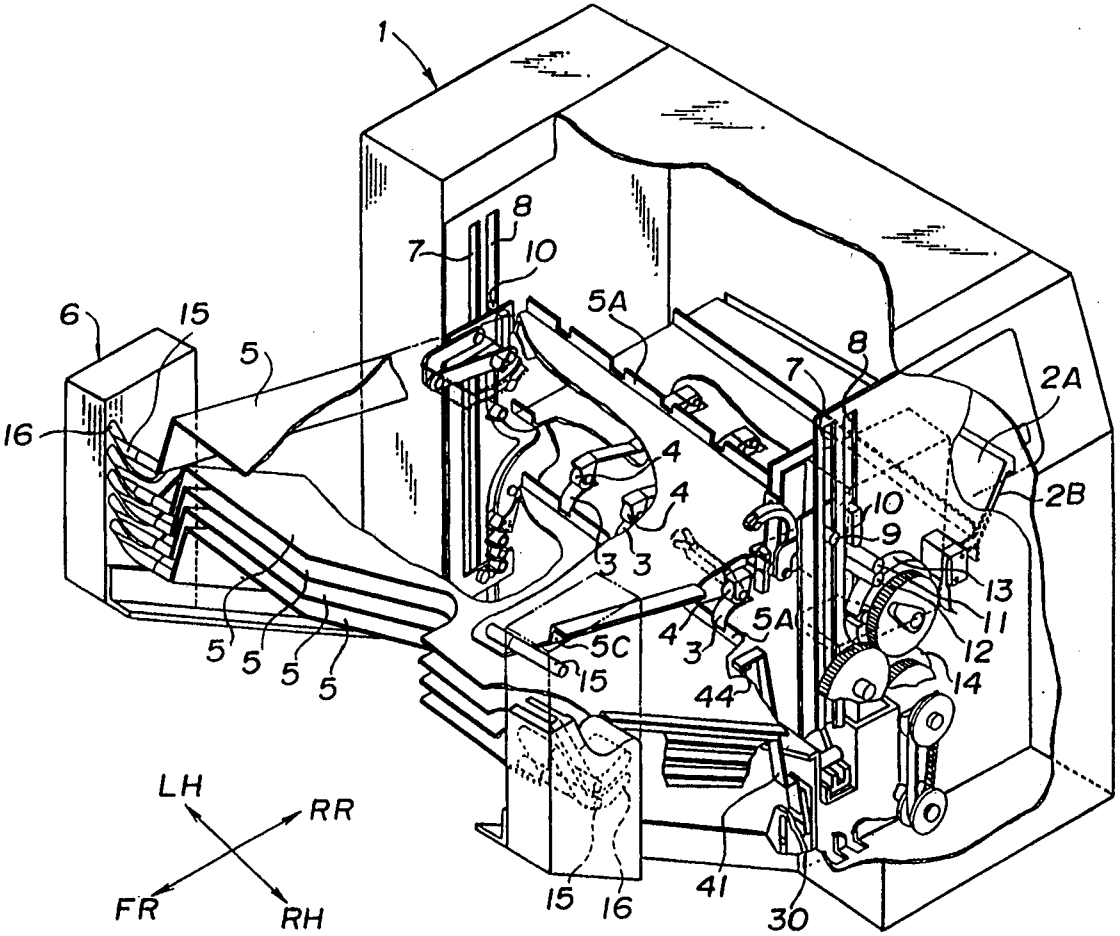
FIG. 1 is a partially exploded perspective view of a sheet sorter constructed according to an embodiment of the present invention.
Figure 2:
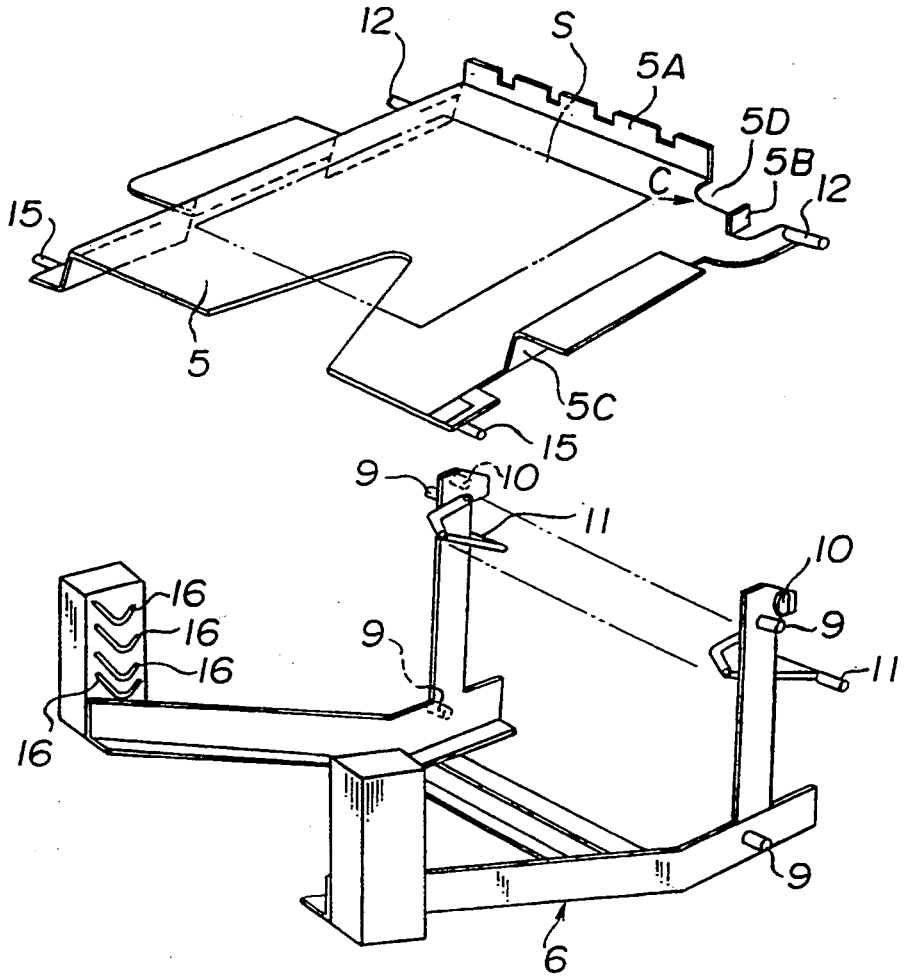
FIG. 2 is a perspective view of a tray and a tray carrier accommodated in the sheet sorter shown in FIG. 1.

Referring to FIG. 1, a sorter housing 1 is arranged on the sheet discharging side of, e.g., a photoelectronic copying machine. As sheets are successively discharged from the copying machine, each sheet passes between upper and lower guide plates 2A and 2B arranged in the sorter housing 1, and subsequently, passes between plural sets of feed rollers 3 and pinch rollers 4 so that it is transferred in the forward direction to reach a sheet outlet port (not shown) located at a predetermined position on the sorter housing 1. After the sheet is discharged from the sheet outlet port, it is selectively placed on one of a plurality of trays 5. Specifically, as shown in FIG. 2, the plurality of trays 5 are held on a tray carrier 6 in such a manner that each of the trays 5 is displaced in accordance with a predetermined order so as to receive the sheet discharged from the sheet outlet port on one of the trays 5 by way of raising/lowering of the whole tray carrier and retracting of each tray 5 in the rearward direction. An opposing pair of first vertically extending slots 7 and an opposing pair of second vertically extending slots 8, which intermediate part is bent in the substantially V-shaped curved state in the rearward direction, are formed on the left-hand and right-hand sides of the sorter housing 1. While guide pins 9 disposed on four corners of the tray carrier 6 on the rear side are slidably fitted into the first slots 7, the tray carrier 6 can slidably be displaced in the upward/-downward direction relative to the sorter housing 1. In addition, resist pins 10 disposed on the tray carrier 6 on the opposite sides, dummy pins 11 disposed in the same way and rear tray pins 12 disposed on each of the trays 5 on the opposite sides are slidably fitted into the second slots 8 in accordance with the order as seen from above. As a pair of upper and lower Geneva wheels are simultaneously driven in the normal direction or in the reverse direction as shown in FIG. 3 while the pins 10, 11 and 12 are arranged in the aforementioned manner, the trays 5 are retracted one by one in the rearward direction (in the rightward direction as seen in FIG. 3), whereby the distance between the retracted tray 5 and the tray 5 directly below the former is largely increased.

Figure 3:
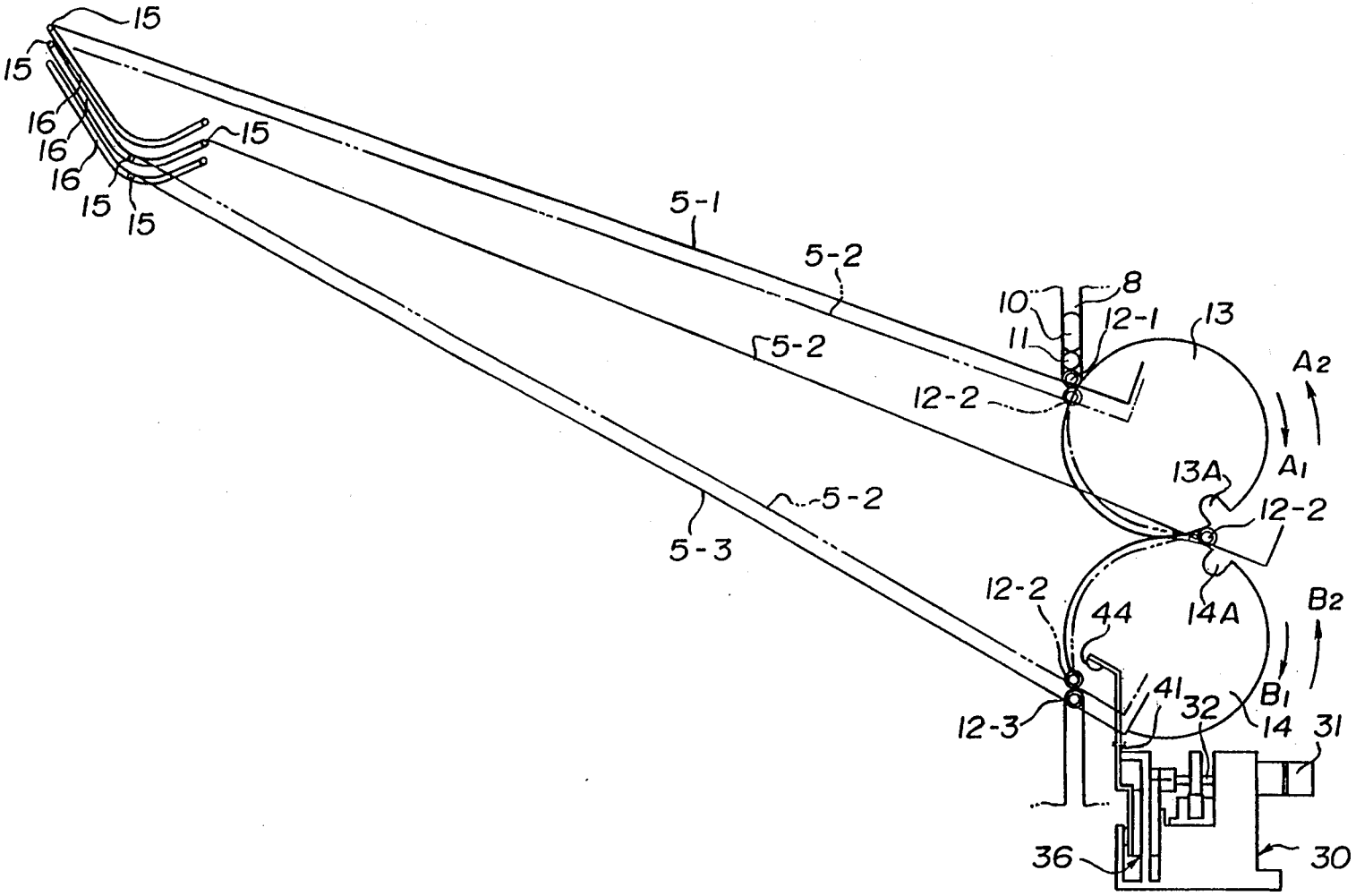
FIG. 3 is a schematic side view of the sheet sorter shown in FIG. 1, particularly illustrating a mode of operation of the sheet sorter.

FIG. 3 shows the state that a second tray 5-2 as counted from above is retracted in the rearward direction. In the case that the upper and lower Geneva wheels 13 and 14 are rotationally driven from the shown state such that the upper Geneva wheel 13 is rotated in the $A_1$ arrow-marked direction and the lower Geneva wheel 14 is rotated in the $B_1$ arrow-marked direction, rear tray pin 12-2 on the second tray 5-2 are taken in a groove 13A on the upper Geneva wheel 13 so that it is displaced along the second slot 8 in the arrow $A_1$-marked direction. Subsequently, when the rear tray pin 12-2 collide against rear tray pin 12-1 on a first tray 5-1, the rear tray pin 12-1, the dummy pin 11 and the resist pin 13 are raised up as represented by phantom lines in FIG. 3, whereby the tray carrier 6 is raised up by one stage via the resist pin 10. While the tray carrier 6 is raised up by one stage in that way, rear tray pin 12-3 on a third tray 5-3 as counted from above are taken in a groove 14A on the lower Geneva wheel 14 so that it is displaced along the second slot 8 in the B1 arrow-marked direction, causing the tray 5-3 to be retracted in the rearward direction (in the rightward direction as seen in FIG. 3).

Subsequently, as the Geneva wheels 13 and 14 are rotationally driven in synchronization with each other such that the upper Geneva wheel 13 is rotated in the A1 arrow marked-direction and the lower Geneva wheel 14 is rotated in the $B_1$ arrow-marked direction in the same manner as mentioned above, the trays 5 are retracted in the rearward direction one by one as in the order as seen from above, whereby the gap between the retracted tray 5 and the tray 5 located directly below the former is largely increased, and at the same time, the tray carrier 6 is raised up by one stage.

On the contrary, in the case that the Geneva wheels 13 and 14 are rotationally driven in synchronization with each other such that the upper Geneva wheel 13 is rotated in the $A_2$ arrow-marked direction and the lower Geneva wheel 14 is rotated in the $B_2$ arrow-marked direction, the tray 5 are retracted in the rearward direction one by one as reversely counted from below, whereby the gap between the retracted tray 5 and the tray 5 located directly below the former is largely increased, and at the same time, the tray carrier 6 is lowered by one stage.

With the sheet sorter constructed in the above-described manner, the sheet discharged from the copying machine is placed on the tray 5 located directly below the tray 5 which has been retracted in the rearward direction. For example, when the second tray 5-2 as counted from above is retracted as represented by solid lines in FIG. 3, each sheet is placed on the third tray 5-3 located directly below the second tray 5-2. It should be noted that front tray pins 15 on each of the trays 5 on the opposite sides are displaceably fitted into substantially V-shaped guide grooves 16 formed on the opposite sides of the tray carrier 6. As is apparent from FIG. 3, the upper surface of each tray 5 slantwise downward extends from the front side to the rear side, and moreover, it slantwise downward extends from the left-hand side (the LH side in FIG. 1) to the right-hand side (the RH side in FIG. 1). Thus, the sheet discharged on the tray 5 (identified by reference character S in FIG. 2) is slantwise slidably displaced toward a rear wall 5A and right-hand side walls 5B and 5C in the C arrow-marked direction.

Next, a sheet arranging device constructed according to the embodiment of the present invention will be described below with reference to FIG. 4 to FIG. 7. Incidentally, the sheet arranging device is accommodated in the sorter housing 1 to automatically properly arrange sheets successively placed one of the trays 5.

Figure 4:
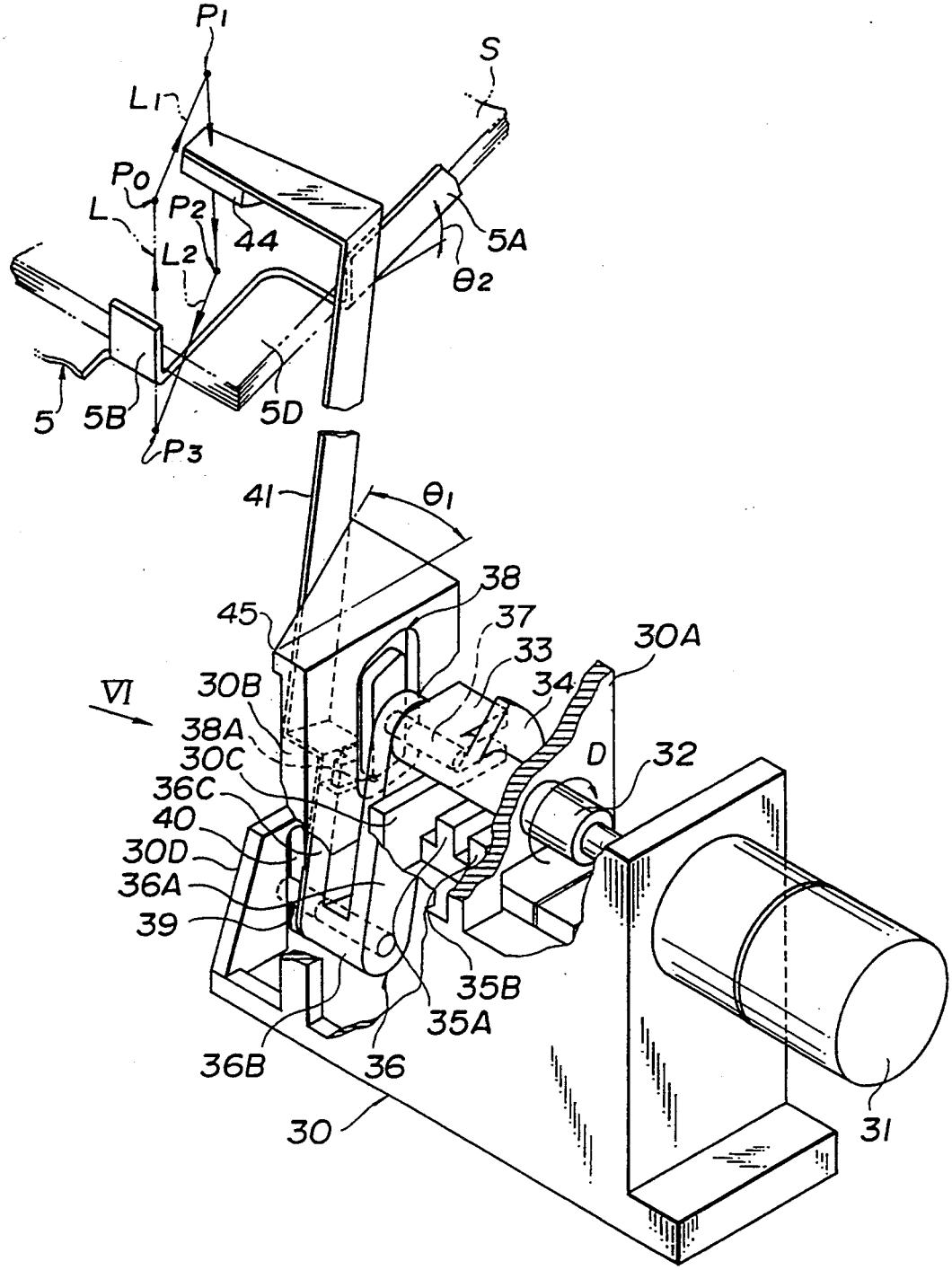
FIG. 4 is a perspective view of a sheet arranging device accommodated in the sheet sorter shown in FIG. 1.

In FIG. 4, reference numeral 31 designates a geared motor mounted in a device housing 30. An output shaft of the geared motor 31 is coupled to one end of a joint shaft 32. The intermediate part of the joint shaft 32 is rotatably supported in a vertical wall portion 30A, while the other end of the same is kept free. A substantially U-shaped cam 33 adapted to slidably receive one end of a first pin 37 to be described later is disposed at the free end of the joint shaft 32, and a substantially sector-shaped shading plate 34 is disposed on the outer peripheral surface of the joint shaft 32. The shading plate 34 serves to interrupt a light path between a light emitting element (not shown) disposed on one sensor base board 35A on the device housing 30 and a light receiving element (not shown) disposed on other sensor board 35B on the device housing 30 every time the joint shaft 32 is rotated. In response to a detecting signal from the light receiving element, a controller (not shown) detects that the joint shaft 32 is rotated to a predetermined rotational position. The foregoing detection signal is hereinafter referred to as "a rotational position detecting signal".

In FIG. 4, reference numeral 36 designates a substantially U-shaped movable member. The intermediate part of the first pin 37 is immovably fitted to the uppermost end of one arm portion 36A of the movable member 36. One end of the first pin 37 is slidably fitted to the substantially U-shaped cam 33, while the other end of the same is slidably fitted to a first parallelepiped-shaped guide groove 38 formed on a vertical wall portion 30B of the device housing 30. A groove portion corresponding to the lower side of the guide groove 38 is represented by an arranging direction groove portion 38A extending substantially in parallel with the sheet arranging direction to be described later.

The arm portion 36A of the movable member 36 is located between both the vertical wall portions 30B and 30C while coming in slidable contact with the vertical surfaces of the vertical wall portions 30B and 30C, a lower end part 36B of the same is kept freely movable in the space located below the vertical wall portion 30B, and other arm portion 36C of the same is located leftward of the vertical wall portion 30B as seen in FIG. 4. One end of a second pin 39 is immovably fitted into the lower end portion 36B of the movable member 36, while other end of the same is slidably fitted into a second guide groove 40 formed through a vertical wall portion 30D of the device housing 30.

Figure 6:
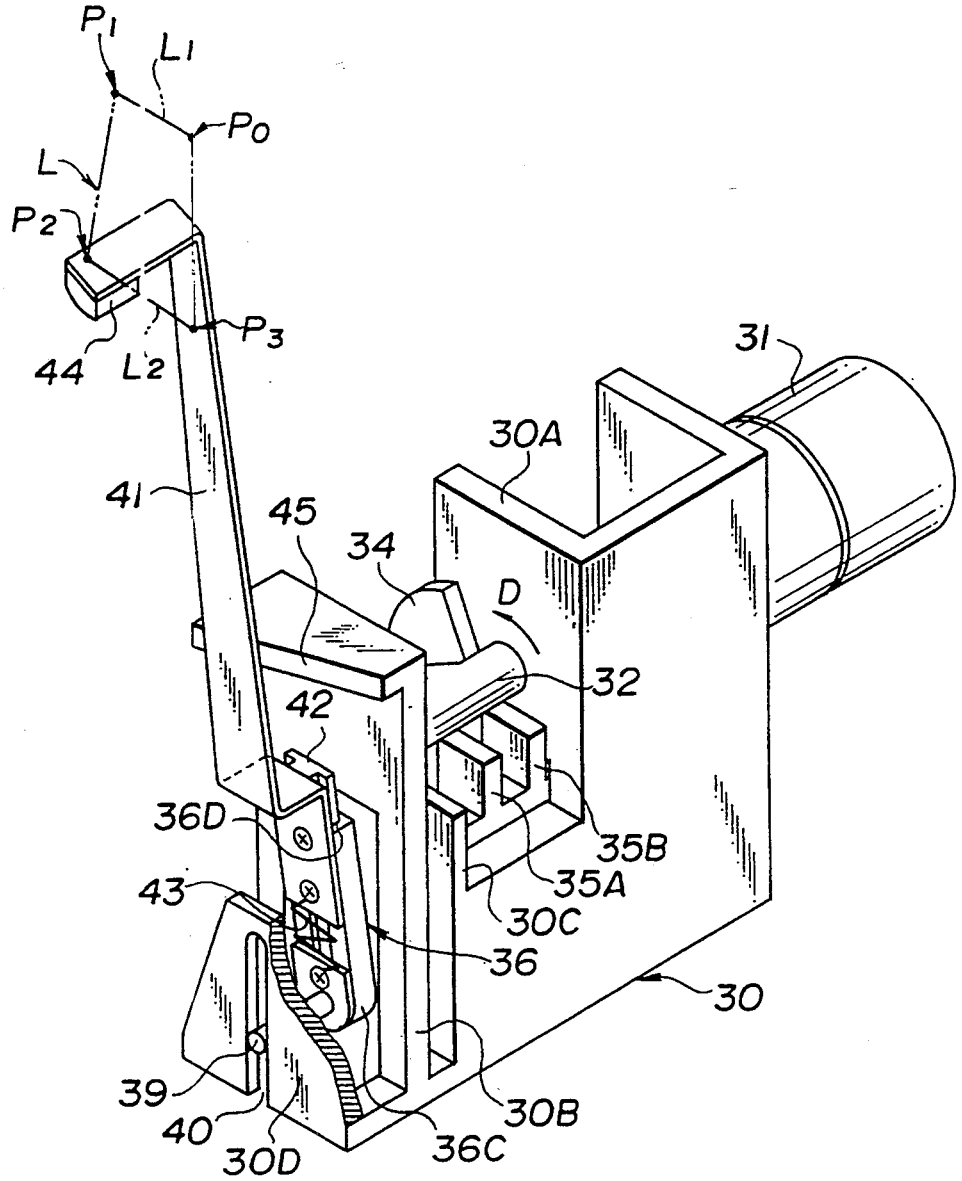
FIG. 6 is a perspective view of the sheet arranging device as seen in the VI arrow-marked direction in FIG. 4.
Figure 7:
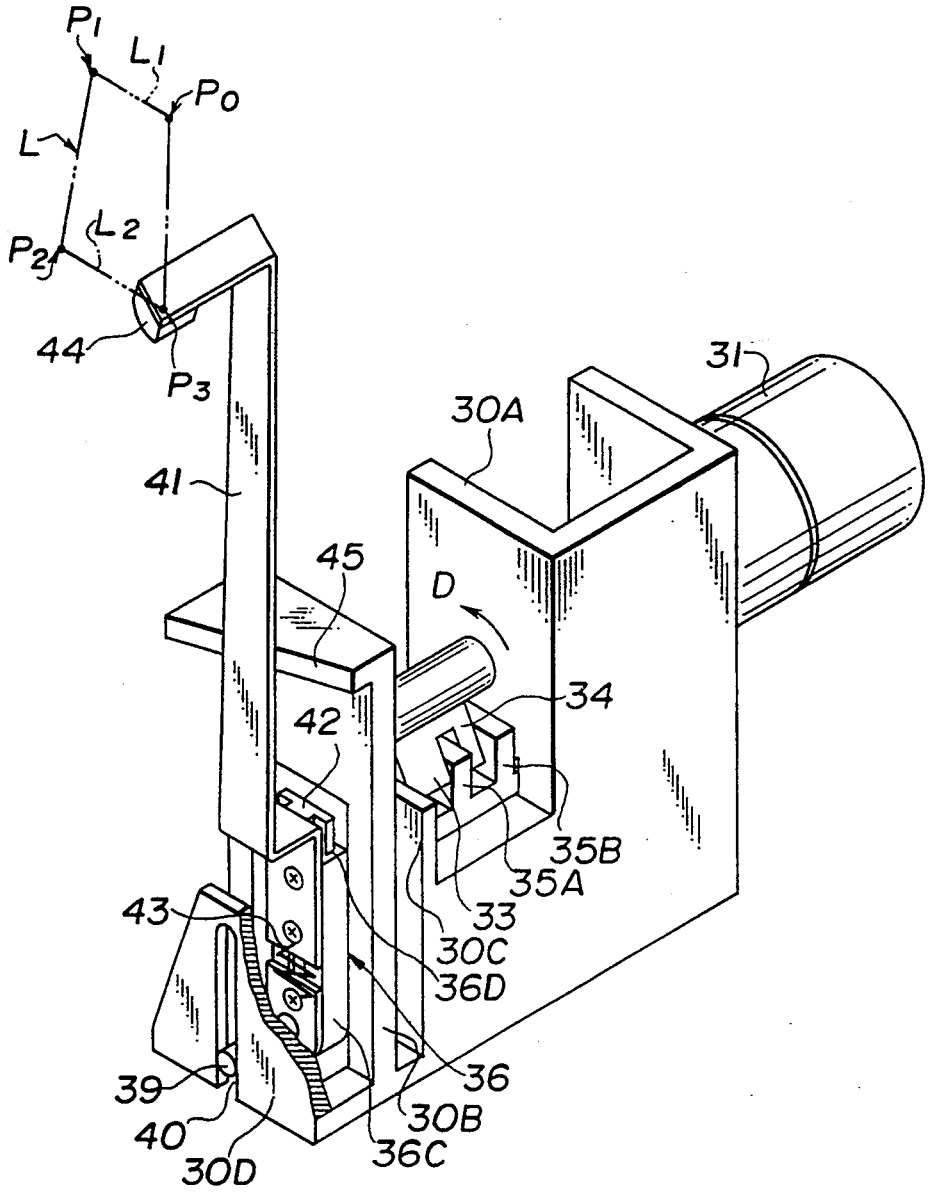
FIG. 7 is a perspective view of the sheet arranging device shown in FIG. 4, particularly illustrating the operative state of the sheet arranging device different from that shown in FIG. 6.

A longitudinally extending groove 36D having a T-shaped sectional contour (see FIG. 6) is formed on the arm portion 36C of the movable member 36 so that a slider 42 fixedly secured to the base end of an arm 41 is slidably fitted into the guide groove 36D. As shown in FIG. 6, a spring 43 for normally biasing the arm 41 toward the second pin 39 is spanned between the base end of the arm 41 and the arm portion 36C. The arm 41 is made of an elastic material, and a frictional member 44 having a concave curved lower surface molded of polyurethane rubber or a similar material is attached to the lower surface of a horizontal portion at the uppermost end of the arm 41. An inclined guide 45 of which guide surface is inclined at a predetermined angle $\theta_1$ (see FIG. 4) as seen from above is formed on the upper surface side of the vertical wall portion 30B, and the intermediate part of the arm 41 is brought in close contact with the guide surface of the inclined guide 45 by the resilient power of the arm 41.

As shown in FIG. 1, the housing 30 of the seat arranging device constructed in the above-described manner is received in the sorter housing 1 so that a sheet arranging operation to be described later is performed for a sheet placed on the tray 5 displaced to the sheet discharging position with the aid of the frictional member 44 disposed at the uppermost end of the arm 41.

Next, a mode of operation of the sheet arranging device will be described below.

Each sheet arranging operation is repeatedly performed every time the cam 33 is rotated from a predetermined stop position in the D arrow-marked direction by a single revolution, and while the cam 33 is held at the predetermined stop position, a rotational position detecting signal is outputted from the controller.

Figures 5A, 5B, 5C, 5D:
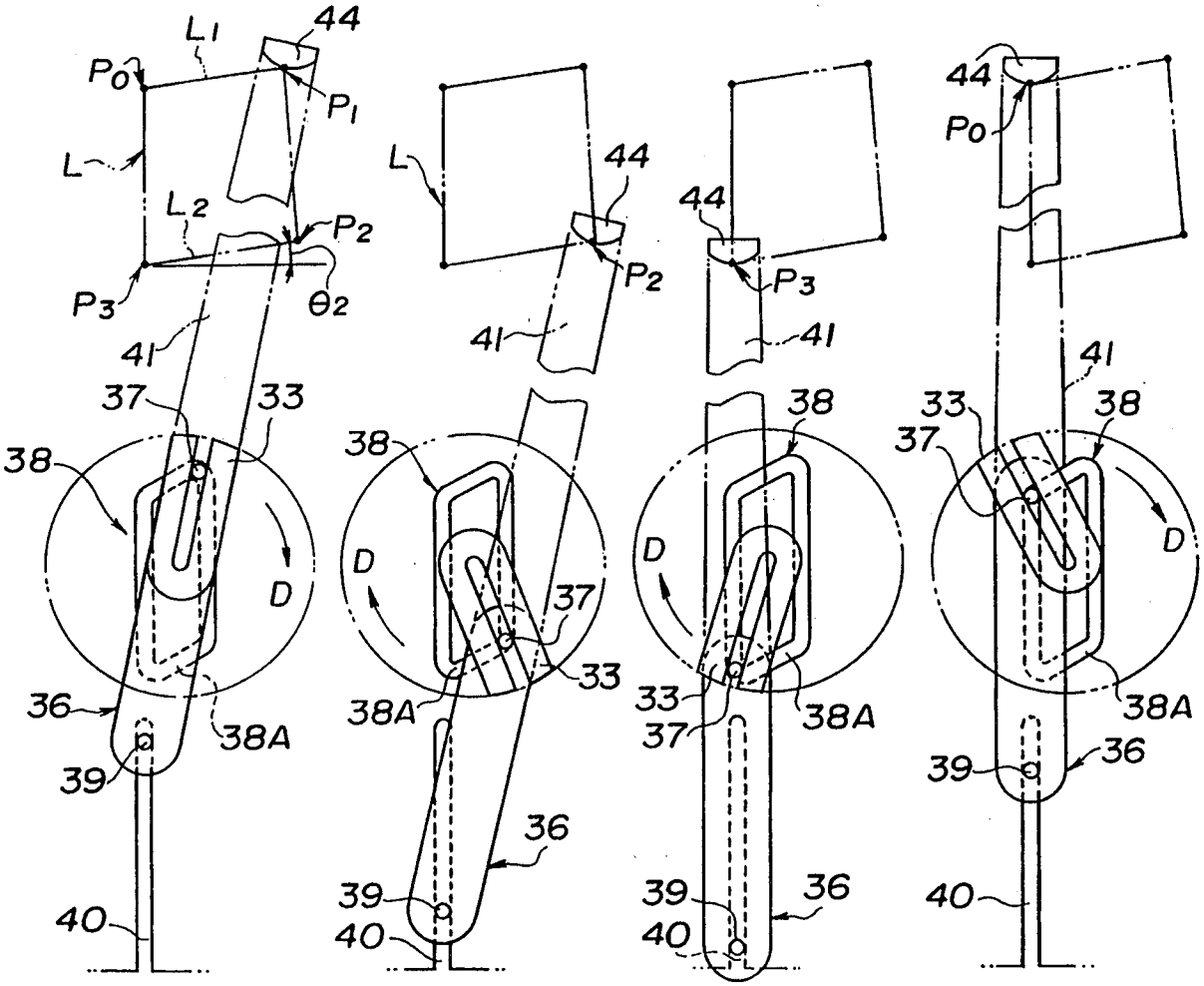
FIG. 5A, FIG. 5B, FIG. 5C and FIG. 5D are schematic side views each of which shows essential components constituting the sheet arranging device shown in FIG. 4, particularly illustrating a mode of operation of the sheet arranging device.

FIG. 5D illustrates the state that the cam 33 is held at the stop position where the first pin 37 is raised up to a left upper corner of the first guide groove 38 by the action of the cam 33. While the cam 33 is rotated from the foregoing stop position in the D arrow-marked direction by a single revolution, the first pin 37 is successively displaced to the right upper corner portion, the right lower corner portion and the left lower corner portion of the first guide groove 38 with the aid of the cam 33 as shown in FIG. 5A, FIG. 5B and FIG. 5C, and thereafter, the first pin 37 returns to the left upper corner of the first guide groove 38 as shown in FIG. 5D at which the movement of the first pin 37 is stopped. Thus, as the movable member 36 is turnably displaced in conformity with the displacement of the first pin 37, the second pin 39 is displaced along the second guide groove 40 in the upward/downward direction.

Consequently, the frictional member 44 disposed at the uppermost position of the arm 41 scribes a rectangular displacement locus L every time the cam 33 is rotated by a single revolution wherein the displacement locus L is started from a position $P_0$ shown in FIG. 5D (hereinafter referred to a waiting position) and returned to the waiting position $P_0$ via a position $P_1$ shown in FIG. 5A, a position $P_2$ shown in FIG. 5B and a position $P_3$ shown in FIG. 5C. The length of the displacement locus $L_1$ between the waiting position $P_0$ and the position $P_1$ is set to be longer than the distance of the displacement of the first pin 37 between the left upper corner portion and the right upper corner portion of the first guide groove 38 shown in FIG. 5A. In addition, the length of the displacement locus $L_2$ between the position $P_2$ and the position $P_3$ (corresponding to a length of the groove portion 38A as seen in the sheet arranging direction) is set to be larger than the distance of the displacement of the first pin 37 between the right lower corner portion and the left lower corner portion of the guide groove 38 shown in FIG. 5A. In other words, a quantity of displacement of the frictional member 44 is amplified by a ratio of the length between the second pin 39 and the frictional member 44 to the length between the first pin 37 and the second pin 39. This means that the frictional member 44 can largely be displaced even though the sheet arranging device is designed with small dimensions.

As shown in FIG. 4, the arm 41 is displaced while coming in close contact with the inclined guide 45. This causes both the loci $L_1$ and $L_2$ of the displacement of the frictional member 44 to be inclined by an angle corresponding to the inclination angle $\theta_1$ of the inclined guide 45 relative to the direction of extension of the rear wall 5A of the tray 5 as shown in FIG. 4. Especially, the locus $L_2$ of the displacement of the frictional member 44 is downward slantwise scribed toward a cutout portion 5D located at the corner portion defined between the rear wall 5A and the right-hand side wall 5B, the displacement position $P_2$ is located above the tray 5, and the displacement position $P_3$ is located in the positionally offset state away from the tray 5. Incidentally, an angle $\theta_2$ in FIG. 4 represents an inclination angle at which the tray 5 is inclined in the downward direction from the left-hand side to the right-hand side thereof. In practice, the angle $\theta_2$ is coincident with the inclination angle of the locus $L_2$ of the displacement of the frictional member 44 as shown in FIG. 5A.

With this construction, the frictional member 44 is brought in contact with the upper surface of a sheet S at the displacement position $P_2$, and as the frictional member 44 moves along the displacement locus $L_2$, the sheet S is slidably displaced toward the cutout portion 5D in the presence of friction between the frictional member 44 and the sheet S until it collides against the rear wall 5A and the right-hand side walls 5B and 5C (see FIG. 2) for the purpose of properly arranging sheets S in the superimposed state. At this time, the frictional member 44 is located at the displacement position $P_3$ positionally offset away from the tray 5, and thereafter, it is raised up to the waiting position $P_0$ where it is held in the waiting state. The waiting position $P_0$ is determined to be coincident with the position where a raising/lowering operation and a retracting operation to be performed for the tray 5 are not obstructed at all. It should be noted that the arm 41 is increasingly displaced against the resilient force of the spring 43 (see FIG. 6) in the upward direction as the number of sheets S placed on the tray 5 in the superimposed state increases while the contact pressure of the frictional member 44 imparted to the sheet S is maintained within the predetermined range.

In addition, a stapler may be mounted on the sorter housing 1 as desired so as to enable a stack of sheets S located at the cutout portion 5D of the tray (see FIG. 4) to be automatically stapled together.

The present invention has been described in detail with respect to preferred embodiments, and it will now be understood that changes and modifications may be made without departing from the invention in its broader aspects, and it is the intention, therefore, in the appended claims to cover all such changes and modifications as fall within the true spirit of the invention.

What is claimed is:

1. A sheet arranging device for properly arranging sheets on a tray in the superimposed state by displacing a sheet in a first predetermined direction, comprising;

an arm having a frictional member disposed at the uppermost end thereof, said frictional member being brought in contact with the upper surface of a sheet with a predetermined intensity of frictional force, first displacing means for annularly displacing said frictional member to assume a first operative state or a second operative state, said first operative state being such that said frictional member is brought in contact with the upper surface of the sheet, and said second operative state being such that said frictional member is not brought in contact with the upper surface of the sheet, said first displacing means comprising:

a main body having a first annular guide groove and a second guide groove formed thereon at predetermined positions thereof, said second guide groove extending in a second predetermined direction, a movable member having said arm operatively secured thereto, said movable member including a first pin at one end and a second pin at the other end thereof, said first pin being displaceably received in said first guide groove, and said second pin being displaceably received in said second guide groove, and second displacing means for displacing said first pin along said first guide groove, and guiding means for guiding the movement of said frictional member so as to allow said frictional member to move substantially in parallel with said first predetermined direction while said frictional member is held in said first operative state.

2. A sheet arranging device according to claim 1, wherein said second displacing means comprises;

a U-shaped cam rotatably supported on said main body so as to allow one end of said first pin to be slidably fitted to said U-shaped cam, and driving means for rotationally driving said U-shaped cam in a predetermined timing relationship.

3. A sheet arranging device according to claim 1, wherein said movable member is designed in a substantially U-shaped configuration comprising a first arm portion having said first pin disposed thereon, a bottom portion having said second pin disposed thereon and a second arm portion, and wherein said arm is attached to said second arm portion via a slider adapted to slidably move in a longitudinal direction of said arm.

4. A sheet arranging device according to claim 3, wherein said arm is made of an elastic material and normally biased together with said slider toward said second pin by the resilient force of a spring.

5. A sheet arranging device according to claim 4, wherein said guiding means comprises;

a portion of said first annular guide groove extending substantially in parallel with said first predetermined direction, and an inclined guide surface formed on said main body so as to allow the intermediate part of said arm to come in contact with said inclined guide surface.

6. A sheet arranging device according to claim 1, wherein said guiding means comprises;

a portion of said first annular guide groove extending substantially in parallel with said first predetermined direction, and an inclined guide surface formed on said main body so as to allow the intermediate part of said arm to come in contact with said inclined guide surface.

7. A sheet arranging device according to claim 1, wherein the distance between said second pin and said frictional member is set to be larger than that between said first pin and said second pin.

8. A sheet sorter comprising;

a plurality of trays each displaceable in the vertical direction, displacing means for selectively displacing one of said plurality of trays to a sheet discharging position, an arm having a frictional member disposed at the uppermost end thereof, said frictional member being brought in contact with the upper surface of a sheet with a predetermined intensity of frictional force, first displacing means for annularly displacing said frictional member to assume a first operative state or a second operative state, said first operative state being such that said frictional member is brought in contact with the upper surface of the sheet, and said second operative state being such that said frictional member is not brought in contact with the upper surface of the sheet, said first displacing means comprising:

a main body having a first annular guide groove and a second vertically extending groove formed thereon at predetermined positions thereof, a movable member having said arm operatively secured thereto, said movable member including a first pin at one end and a second pin at the other end thereof, said first pin being displaceably received in said first guide groove, and said second pin being displaceably received in said second guide groove, and second displacing means for displacing said first pin along said first guide groove, said second displacing means comprising:

a U-shaped cam rotatably supported on said main body so as to allow one end of said first pin to be slidably fitted to said U-shaped cam, and driving means for rotationally driving said U-shaped cam in a predetermined timing relationship, and guiding means for guiding the movement of said frictional member so as to allow said frictional member to move in a predetermined direction relative to said trays.

9. A sheet sorter comprising;

a plurality of trays each displaceable in the vertical direction, displacing means for selectively displacing one of said plurality of trays to a sheet discharging position, an arm having a frictional member disposed at the uppermost end thereof, said frictional member being brought in contact with the upper surface of a sheet with a predetermined intensity of frictional force, first displacing means for annularly displacing said frictional member to assume a first operative state or a second operative state, said first operative state being such that said frictional member is brought in contact with the upper surface of the sheet, and said second operative state being such that said frictional member is not brought in contact with the upper surface of the sheet, said first displacing means comprising:

a main body having a first annular guide groove and a second vertically extending groove formed thereon at predetermined positions thereof, a movable member having said arm operatively secured thereto, said movable member including a first pin at one end and a second pin at the other end thereof, said first pin being displaceably received in said first groove, and said second pin being displaceably received in said second guide groove, wherein said movable member is designed in a substantially U-shaped configuration comprising a first arm portion having said first pin disposed thereon, a bottom portion having said second pin disposed thereon and a second arm portion, and said arm is attached to said second arm portion via a slider adapted to slidably move in a longitudinal direction of said arm, and second displacing means for displacing said first pin along said first guide groove, and guiding means for guiding the movement of said frictional member so as to allow said frictional member to move in a predetermined direction relative to said trays.

10. A sheet sorter according to claim 9, wherein said arm is made of an elastic material and normally biased together with said slider toward said second pin by the resilient force of a spring.

11. A sheet sorter according to claim 10, wherein said guiding means comprises;

a groove portion formed in the intermediate part of said first annular guide groove while extending substantially along with said predetermined direction, and an inclined guide surface formed on said main body so as to allow the intermediate part of said arm to come in contact with said inclined guide surface.

12. A sheet sorter comprising;

a plurality of trays each displaceable in the vertical direction, displacing means for selectively displacing one of said plurality of trays to a sheet discharging position, an arm having a frictional member disposed at the uppermost end thereof, said frictional member being brought in contact with the upper surface of a sheet with a predetermined intensity of frictional force, first displacing means for annularly displacing said frictional member to assume a first operative state or a second operative state, said first operative state being such that said frictional member is brought in contact with the upper surface of the sheet, and said second operative state being such that said frictional member is brought in contact with the upper surface of the sheet, said first displacing means comprising:

a main body having a first annular guide groove and a second vertically extending groove formed thereon at predetermined positions thereof, a movable member having said arm operatively secured thereto, said movable member including a first pin at one end and second pin at the other end thereof, said first pin being displaceably received in said first guide groove, and said second pin being displaceably received in said second guide groove, and second displacing means for displacing said first pin along said first guide groove, and guiding means for guiding the movement of said frictional member so as to allow said frictional member to move in a predetermined direction relative to said trays, said guiding means comprising:

a portion of said first annular guide groove extending substantially in parallel with said predetermined direction, and an inclined guide surface formed on said main body so as to allow the intermediate part of said arm to come in contact with said inclined guide surface.

13. A sheet sorter comprising;

a plurality of trays each displaceable in the vertical direction, displacing means for selectively displacing one of said plurality of trays to a sheet discharging position, an arm having a frictional member disposed at the uppermost end thereof, said frictional member being brought in contact with the upper surface of a sheet with a predetermined intensity of frictional force, first displacing means for annularly displacing said frictional member to assume a first operative state or a second operative state, said first operative state being such that said frictional member is brought in contact with the upper surface of the sheet, and said second operative state being such that said frictional member is not brought in contact with the upper surface of the sheet, said first displacing means comprising:

a main body having an first annular guide groove and a second vertically extending groove formed thereon at predetermined positions thereof, a movable member having said arm operatively secured thereto, said movable member including a first pin at one end and a second pin at the other end thereof, said first pin being displaceably received in said first guide groove, and said second pin being displaceably received in said second guide groove, wherein a distance between said second pin and said frictional member is set to be larger than that between said first pin and said second pin, and second displacing means for displacing said first pin along said first guide groove, and guiding means for guiding the movement of said frictional member so as to allow said frictional member to move in a predetermined direction relative to said trays.

* * * * *